US008113687B2

(12) United States Patent
Villard et al.

(10) Patent No.: US 8,113,687 B2
(45) Date of Patent: Feb. 14, 2012

(54) MODULAR LED LIGHTING FIXTURE

(75) Inventors: Russell George Villard, Apex, NC (US); John Perry, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 11/689,872

(22) Filed: Mar. 22, 2007

(65) Prior Publication Data

US 2008/0002399 A1 Jan. 3, 2008

Related U.S. Application Data

(60) Provisional application No. 60/817,110, filed on Jun. 29, 2006.

(51) Int. Cl.
*F21S 4/00* (2006.01)

(52) U.S. Cl. ..... 362/249.01; 362/231; 362/249.02; 362/800; 362/431

(58) Field of Classification Search ..... 362/153, 362/153.1, 299, 800, 249.01, 249.02, 249.03, 362/249, 373, 431, 217.01, 217.06
See application file for complete search history.

(56) References Cited

U.S. PATENT DOCUMENTS

| | | | | |
|---|---|---|---|---|
| 3,808,415 | A * | 4/1974 | Hurst | 362/604 |
| 4,654,629 | A * | 3/1987 | Bezos et al. | 246/473.3 |
| 5,268,828 | A * | 12/1993 | Miura | 362/249.06 |
| 5,876,831 | A * | 3/1999 | Rawal | 428/117 |
| 6,065,854 | A * | 5/2000 | West et al. | 362/249.06 |
| 6,286,978 | B1 * | 9/2001 | Tait et al. | 362/249.06 |
| 6,314,669 | B1 * | 11/2001 | Tucker | 40/448 |
| 6,467,928 | B2 * | 10/2002 | Crelin | 362/147 |
| 7,008,080 | B2 * | 3/2006 | Bachl et al. | 362/249 |
| 7,192,154 | B2 * | 3/2007 | Becker | 362/133 |
| 7,287,879 | B2 * | 10/2007 | Hsu | 362/294 |
| 7,384,170 | B2 * | 6/2008 | Skegin | 362/240 |
| 7,513,639 | B2 * | 4/2009 | Wang | 362/218 |
| 7,766,513 | B2 * | 8/2010 | Zhang et al. | 362/294 |
| 7,854,534 | B2 * | 12/2010 | Liu | 362/294 |
| 2003/0156430 | A1 * | 8/2003 | Ota et al. | 362/574 |
| 2003/0223217 | A1 * | 12/2003 | Wright et al. | 362/31 |
| 2005/0201088 | A1 * | 9/2005 | Stach et al. | 362/225 |
| 2006/0023443 | A1 * | 2/2006 | Connelly et al. | 362/161 |
| 2006/0087843 | A1 * | 4/2006 | Setomoto et al. | 362/249 |
| 2006/0181878 | A1 * | 8/2006 | Burkholder | 362/294 |
| 2006/0203465 | A1 * | 9/2006 | Chang et al. | 362/29 |
| 2006/0209528 | A1 * | 9/2006 | Demarb et al. | 362/29 |
| 2007/0070615 | A1 * | 3/2007 | Joslin et al. | 362/92 |
| 2007/0247851 | A1 | 10/2007 | Villard | |
| 2008/0001160 | A1 | 1/2008 | Andrews | |
| 2008/0002399 | A1 | 1/2008 | Villard et al. | |
| 2008/0030981 | A1 * | 2/2008 | Mrakovich et al. | 362/219 |
| 2008/0062691 | A1 | 3/2008 | Villard | |
| 2008/0212329 | A1 * | 9/2008 | Duguay et al. | 362/310 |
| 2009/0323347 | A1 * | 12/2009 | Zhang et al. | 362/294 |

OTHER PUBLICATIONS

"LED Outdoor Luminaire & Light Fixtures" by Leotek Electronics Corporation, www.leotek.com, at least as early as Jun. 16, 2006.

(Continued)

*Primary Examiner* — Evan Dzierzynski
(74) *Attorney, Agent, or Firm* — Jenkins, Wilson, Taylor & Hunt, P.A.

(57) ABSTRACT

A modular LED lighting fixture is provided, where the shape and brightness of light output from the fixture can be altered by changing LED modules and/or power supplies powering the modules within the fixture. The fixture can include a housing, a modular, removable LED module attached within the housing, and at least one modular, removable power supply attached to the housing for powering the LED module.

32 Claims, 8 Drawing Sheets

OTHER PUBLICATIONS

"LED Streetlight Luminaire in Cobrahead M-400 Housing," by Ledtronics, Inc., http://www.ledtronics.com/ds/SLT002/default.asp, at least as early as Jun. 16, 2006.

Magtech LP 1090-XX-YZ-E Series Switch-Mode LED Driver, as listed in "Product Specifications" of Magtech Industries Corp., Oct. 2, 2006 (2 pages).

* cited by examiner

MODULAR LED LIGHTING FIXTURE

PRIORITY STATEMENT

This non-provisional patent application claims the benefit under 35 U.S.C. §119(e) of U.S. Provisional Patent Application Ser. No. 60/817,110, filed Jun. 29, 2006, the entire contents of which are hereby incorporated by reference herein.

BACKGROUND

1. Field

Example embodiments in general relate to a modular light emitting diode (LED) lighting fixture.

2. Description of the Related Art

Light emitting diodes (LEDs) are widely used in consumer lighting applications. In consumer applications, one or more LED dies (or chips) are mounted within a LED package or on an LED module, which may make up part of a lighting fixture which includes one or more power supplies to power the LEDs. The package or module in a lighting fixture includes a packaging material with metal leads (to the LED dies from outside circuits), a protective housing for the LED dies, a heat sink, or a combination of leads, housing and heat sink. Various implementations of the LED lighting fixtures including one or more LED modules are available in the marketplace to fill a wide range of applications, such as area lighting, indoor lighting, backlighting for consumer electronics, etc.

Conventional area lighting such as roadway lights uses high pressure sodium (HPS) bulbs which provide omni-directional light. Reflectors are used to direct some of this light, but much of the light is lost illuminating unintended spaces. For example with HPS bulbs, the typical lumen amount will be in the tens of thousands of lumens, but all of that output does not illuminate the intended area, such as a roadway area for example.

LEDs offer improved light efficiency, a longer lifetime, lower energy consumption and reduced maintenance costs, as compared to HPS light sources. Conventional HPS bulbs are susceptible to maintenance loss and surface, dirt and other losses. Conventional area lighting fixtures are attached on poles, include omni-directional HPS bulbs, and employ reflectors to illuminate the roadway in different patterns based on different situations.

FIGS. 7A to 7G show types of roadway illumination. The Illuminating Engineering Society of North America (IESNA) is the recognized technical authority on illumination and puts out specifications for the five primary types of roadway illumination. As shown in FIGS. 7A to 7G, there are five primary types of roadway illumination. Type I illumination is a direct illumination in two directions along the direction of the roadway (if the road is a single road) and/or in a straight directional pattern at a cross section as shown in FIG. 7B. FIG. 7C shows an Omni directional lighting pattern across the entire intersection, and Fig. shows a lighting fixture which directs light at an angle to normal in either two directions, or in four directions as shown in FIG. 7E.

Type III illumination in FIG. 7F shows a different angled illumination from normal as compared to Type II in FIG. 7D, where the angle of illumination from normal is narrower to reflect a smaller coverage area. Type IV illumination (FIG. 7G) has an even narrower angle of illumination from normal to create a different, smaller illumination area than either Type III or Type II.

Conventionally, these HPS lighting fixtures must be replaced with a completely different fixture to change the lighting pattern at a given location. In order to change the shape and brightness of light output from the HPS fixture, there is no way to alter the pattern other than replacing the entire fixture. Similarly for LED lighting fixtures mounted on poles for area lighting applications, the entire fixture must be replaced in order to change the shape and brightness.

SUMMARY

An example embodiment is directed to a modular light emitting diode (LED) fixture. The fixture includes a housing, a modular, removable LED module attached within the housing, and at least one modular, removable power supply attached to the housing for powering the LED module.

Another example embodiment is directed to a modular LED fixture which includes a housing and a plurality of individually removable PCB strips attached within the housing. Each strip has one or more LEDs thereon. The fixture includes at least one modular, removable power supply attached to the housing for powering the LEDs on the PCB strips.

Another example embodiment is directed to a modular LED fixture having a housing, a removable array of LEDs within the housing, and at least one modular, removable power supply attached within the housing for powering the LED array. The LED array and power supply are arranged in side-by-side relation within the housing.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments.

DETAILED DESCRIPTION OF EXAMPLE EMBODIMENTS

Figure 1:
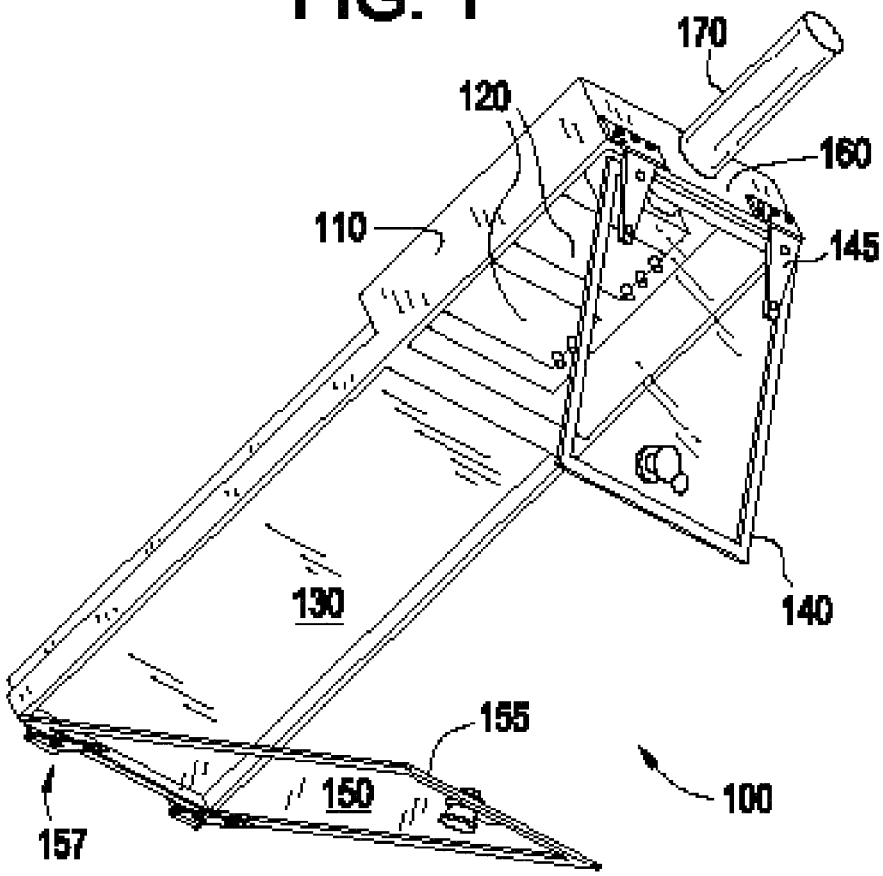
FIG. 1 is a bottom view of an example modular LED lighting fixture with power supplies.

As used herein, the term "lens" or "window" may be understood as a device for either concentrating or diverging light, typically formed from a piece of shaped glass, polymer or plastic. For example, a lens as described herein may be embodied as a generally semi-spherical piece of shaped glass, polymer or plastic for concentrating or diverging light emitted from a light emitting die or LED assembly. A "flextape" as used herein may be understood as a polymer like film which in one high temperature example may be composed of a polyimide, i.e., a flexible polyimide circuit having at least one polyimide layer and at least one conductive layer within a flexible plastic resin. The conductive layer forms a metal trace connected to LED or LED assembly or array.

An LED package can be synonymous with an LED module for the following discussion. Additionally, the modular LED fixture including replaceable LED modules and power supplies may be applicable in general to area lighting applications, inclusive but not limited to street lighting, parking lot lighting and security lighting.

Example embodiments illustrating various aspects of the present invention will now be described with reference to the figures. As illustrated in the figures, sizes of structures and/or portions of structures may be exaggerated relative to other structures or portions for illustrative purposes only and thus are provided merely to illustrate general structures in accordance with the example embodiments.

Furthermore, various aspects of the example embodiments may be described with reference to a structure or a portion being formed on other structures, portions, or both. For example, a reference to a structure being formed "on" or "above" another structure or portion contemplates that additional structures, portions or both may intervene there between. References to a structure or a portion being formed "on" another structure or portion without an intervening structure or portion may be described herein as being formed "directly on" the structure or portion.

Additionally, relative terms such as "on" or "above" are used to describe one structure's or portion's relationship to another structure or portion as illustrated in the figures. Further, relative terms such as "on" or "above" are intended to encompass different orientations of the device in addition to the orientation depicted in the figures. For example, if a device or assembly in the figures is turned over, a structure or portion described as "above" other structures or portions would be oriented "below" the other structures or portions. Likewise, if a device or assembly in the figures is rotated along an axis, a structure or portion described as "above" other structures or portions would be oriented "next to", "left of" or "right of" the other structures or portions.

An example embodiment of the present invention is directed to a modular LED lighting fixture, where the shape and brightness of light output from the fixture can be altered by changing LED modules within the fixture and/or power supplies powering the modules in the fixture. In an example, a given LED module within the fixture includes one or more LEDs mounted on a carrier. Secondary optics or reflectors can be provided over and around the LEDs within the module to shape the total light output of the LED module. Different modules having different LEDs, optics and/or reflector arrangements for different light shapes can be interchangeable within a particular modular LED lighting fixture.

In another example, the light fixture includes interchangeable power supplies that drive the LED modules. The power supplies can be replaced (swapped out) in an effort to alter and/or adjust the brightness and/or performance characteristics of the fixture, depending on a desired application.

In one example, the modular LED lighting fixture is applicable to area lighting applications such as roadway street lights, parking lot lights and security lighting. However, the example embodiments are not so limited, as it would evident to one of skill in the art to use the example modular LED lighting fixtures in other lighting applications, such as within an office building, home, park or any place where it is desired to use most or all of the light output to illuminate an intended area, and not just a general area of interest. Roadway lights typically are located between 20-40 feet above a road and can be classified as any of Type I, II, III, IV or V, according to the shape of the light output. Accordingly, the example embodiments can provide a single modular LED lighting fixture mounted on a suitable structure above the area of interest which is easily alterable between the various types of lighting by swapping out the different LED modules. The brightness and/or performance of the modular LED lighting fixture can be adjusted by adding, subtracting and/or replacing power supplies therein.

FIG. 1 is a bottom view to illustrate an example modular LED lighting fixture with power supplies. These interchangeable power supplies include constant current drivers which supply a constant but adjustable current with a varying voltage. The voltage may vary depending on the number of LEDs used in giving LED modules of the lighting fixture. As the power supplies may also by modular, additional power supplies may be added, subtracted and/or replaced to modify the light output (brightness) and performance of the modular LED lighting fixture.

Referring now to FIG. 1, the modular LED lighting fixture 100 includes a fixture housing 110 which houses a power supply unit 120 and a removably attached LED module 130. Specific details of the LED module 130 are not shown in FIG. 1 for purposes of clarity. The fixture housing 110 may include a protective door 140 for protecting the power supply unit 120 from the environmental conditions. The door 140 may be made of a suitable metal such as aluminum and is connected at a set of hinges 145 to the fixture housing 110 via suitable fasteners, such as rivets or screws for example.

The LED module 130 is protected by a hinge able window 150 which may be made suitable glass or opaque material rimmed by an outer metal frame 155 and hinged at 157 to the fixture housing 110. The fixture housing 110 includes an opening 160 for receiving a support 170. An example of the support 170 may be a street light pole, or any other supporting structure to secure the modular LED fixture 100 in place.

The power supply unit 120 may be secured to an interior surface of the fixture housing 110 with suitable fasteners such as screws, so as to be easily removable. The power supply unit 120 may be switched out and replaced with any other power supply unit, of any size, so long as it fits within the footprint of the space available within the fixture housing 110.

The power supplies may be constant current drivers which supply constant but adjustable current with variable voltage, depending on the number of LEDs. For example, a suitable power supply may be a switch mode, switching LP 1090 series power supply manufactured by MAGTECH, such as the MAGTECH LP 1090-XXYZ-E series switchmode LED driver, for example. The driver has an adjustable voltage range and the type of driver depends on the voltage drop of each of the LEDs in series in the LED matrix.

Figure 2:
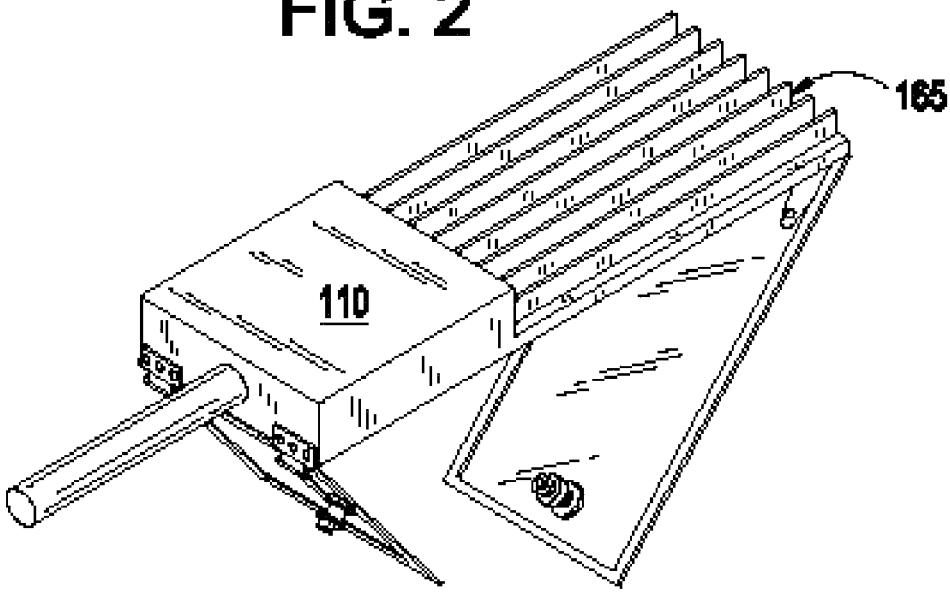
FIG. 2 is a top view of the modular LED fixture in FIG. 1 to illustrate visible heat spreading components.

FIG. 2 is a top view of the fixture 100 with visible heat spreading components. Referring to FIG. 2 and looking at a top side of the fixture 100, a plurality of fins 165 also known as heat spreading T-bars may be provided with channel spacings there between to facilitate thermal dissipation. In one example, these fins 165 may be formed as part of a single cast modular fixture housing 110. The fixture housing 110 may be made of a suitable material providing a heat sinking or heat spreading capability, such as aluminum, ceramic and/or other materials.

Figure 3:
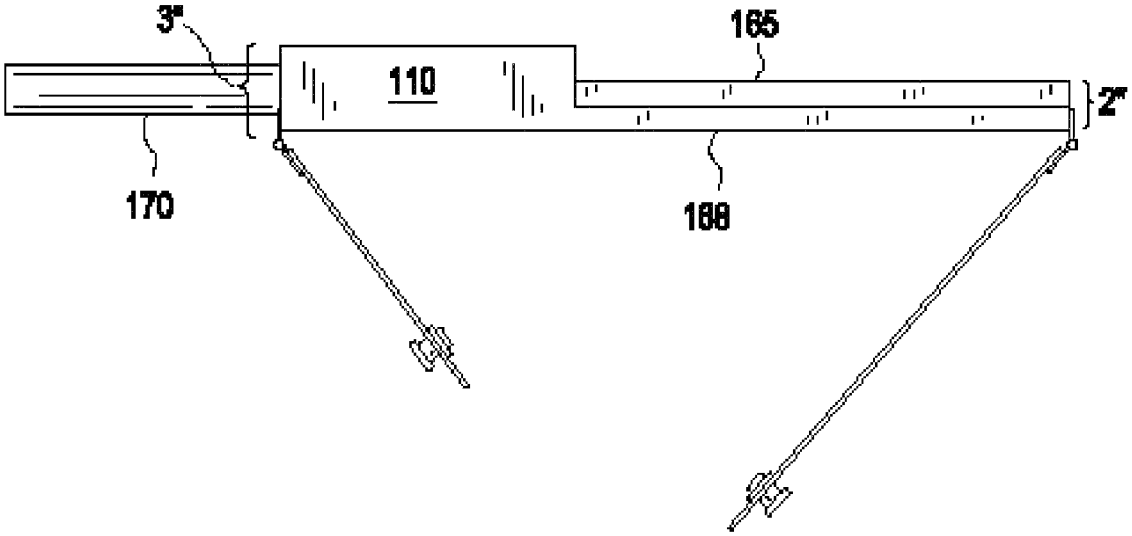
FIGS. 3 and 4 illustrate side views of the modular LED fixture to illustrate the thin footprint from the LED fixture on a suitable support.
Figure 4:
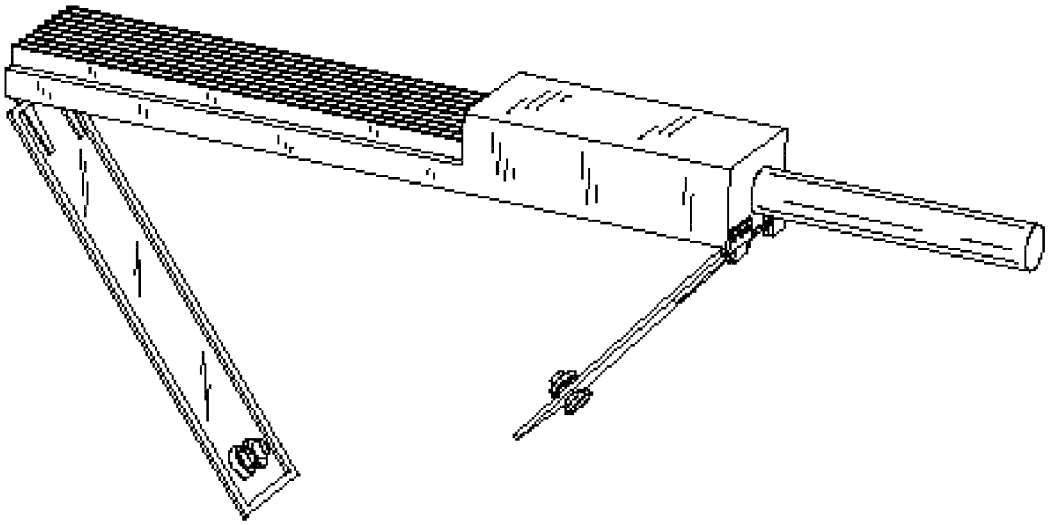

FIGS. 3 and 4 illustrate side views of the modular LED fixture to illustrate the thin footprint from the LED fixture on a suitable support 170. As shown in FIGS. 3 and 4, the widest portion at junction 180 where the support 170 meets the fixture housing 110 has a thickness of 3 inches. The fins 165 have a height of 1 inch and the thin portion 168 of the fixture housing 110 has a width cross sectional height of 1 inch, for a total thickness of two inches. The cross sectional thickness at the widest part of fixture housing is 3'. The fins 165 have a thermal surface area of 240 $in^2$, and the remainder of fixture housing 110 provides another 120 $in^2$ thermal surface area to dissipate heat generated by the LEDs 135. In an example, the LED module 130 consumes at least 90 W of power. The thin cross-section provides a fixture 100 that has a small, narrow footprint, but which is capable of high-power, high-performance lighting applications.

Figure 5:
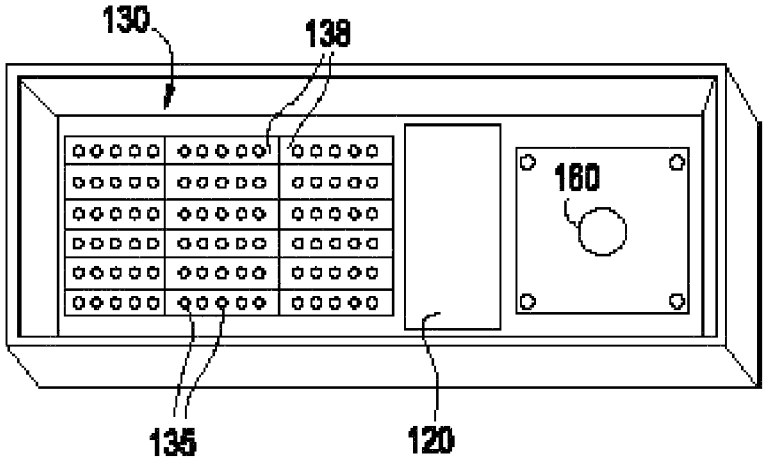
FIG. 5 is a detailed bottom view of the modular LED lighting fixture showing the LED light module in more detail.

FIG. 5 is a detailed bottom view of the modular LED lighting fixture 100 showing the LED light module 130 in more detail. In FIG. 5 the door 140 and window 150 have been removed for purposes of clarity. As shown in FIG. 5, the LED module 130 includes one or more LED lamps 135. The LEDs 135 are mounted on printed circuit board (PCB) strips 138, which in turn are attached to a suitable backing plate (not shown), which may be made of a suitable thermally conducted material such as copper, for example. The strips 138 of LEDs 135 may be secured to an interior surface of the fixture housing 110 with suitable fasteners such as screws, so as to be easily removable. One, some or all strips 138 may be switched out and replaced with any other strips 138, of any size, so long as it fits within the footprint of the space available for the LED module 130 within the fixture housing 110. In an alternative, a backing plate supporting all strips 138 of the module 130 may be may be secured to an interior surface of the fixture housing 110 with suitable fasteners such as screws, so as to be easily removable. The entire LED module 130 may be switched out and replaced with another LED module 130, of any size, so long as it fits within the footprint of the space available within the fixture housing 110.

The LEDs 135 may be configured to emit any desired color of light. The LEDs may be blue LEDs, green LEDs, red LEDs, different color temperature white LEDs such as warm white or cool or soft white LEDs, and/or varying combinations of one or more of blue, green, red and white LEDs 135. In an example, white light is typically used for area lighting such as street lights. White LEDs may include a blue LED chip phosphor for wavelength conversion.

One, some or all LEDs 135 in LED module 130 may be fitted with a secondary optic that shapes the light output in a desired shape, such as circle, ellipse, trapezoid or other pattern. The embodiment in FIG. 5 illustrates a fixture 100 which may be operate in the 70 to 150 watt range with a total of 90 individual LEDs 135 on eighteen (18) PCBs 138 of the module 130. Also, shown in FIG. 5 are the power supply unit 120 and the opening 160 for receiving the support 170.

In an example, the mounting surface area for LED module 130 within fixture housing 110 can be up to about 90 $in^2$, based on the dimensions of the example fixture 100. The average lumen output depends on the rating of LEDs 135 within LED module 130. In an example, each of the LEDs 135 can have an average light output in a range of between 70-90 lumens, which enables the fixture 100 to be able to generate a total lumen output in a range between about 6300 to 8100 lumens. For the LED module 130, the light output per square inch of module 130 surface area can be in a range of about 70 to 90 lumens/$in^2$. However, it would be evident to the skilled artisan that the fixture 100 could be configured to generate a total light output less than 6300 lumens or greater than 8100 lumens, based on the configuration of LEDs 135 in the LED module 130 therein.

Figure 6:
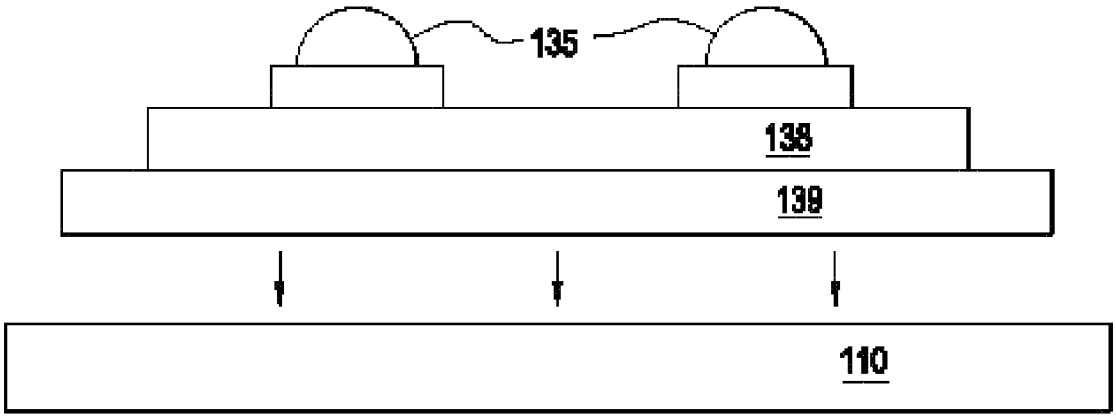
FIG. 6 is a cross sectional view of a given LED module.
Figure 7A:
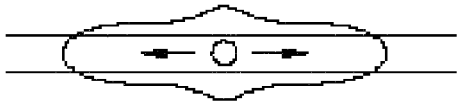
FIGS. 7A to 7G illustrate types of roadway illumination.
Figure 7B:
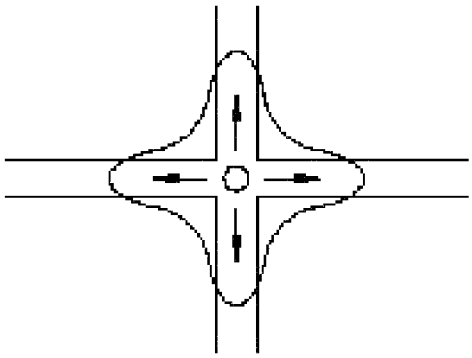
Figure 7C:
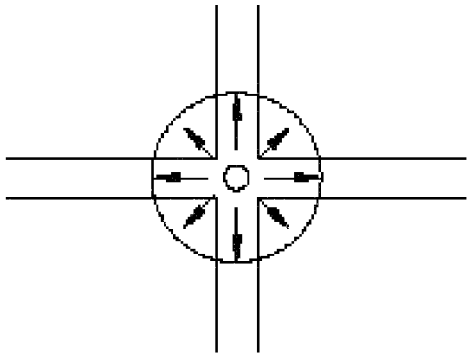
Figure 7D:
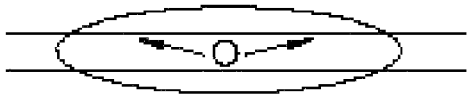
Figure 7E:
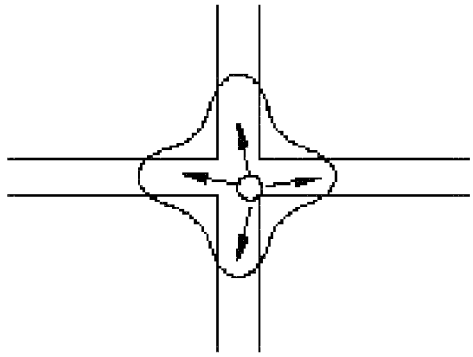
Figure 7F:
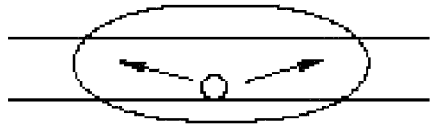
Figure 7G:
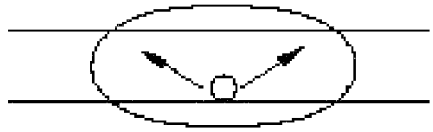

FIG. 6 is a cross sectional view of a given LED module 130. In FIG. 6 two LEDs 135 are shown, it being understood that any number of LEDs may be provided in a array of LEDs for example (i.e., serial columns in parallel). The LEDs 135 may be mounted on a printed circuit board 138 that is mounted onto a copper backing (plate or sheet) 139. The backing 139 may be used to help spread heat generated by the LEDs 135 and to compensate for thermal resistance between components of the LED module 130. It is understood that materials with good thermal conductivity other than copper may also be used such as silver, alloys of copper or silver or other metal materials having high thermal conduction properties. In FIG. 6, each group of five (5) LEDs 135 can be mounted to a five-inch long PCB strip 138, with each PCB strip 138 adhered to the removable copper sheet via a suitable thermal epoxy or paste.

Referring to FIG. 5, the shape of the module 130 is irrelevant; it can be trapezoidal, oval, square, rectangular, circular, etc. so long as it fits within the footprint of the fixture housing 110. Additionally, the type of power supply used does not matter, and a suitable variable power supply such as the LP 1090 may be automatically variable between 90 and 240 volts depending on the particular application of the modular LED lighting fixture 100.

As for the individual LEDs 135 of the module 130, the LEDs 135 may be slanted at different angles, at the same angles, in groups of angles which differ from group to group, etc. For example, in an area lighting application, the shape of the light output may be varied by the angle of the LEDs from normal, the shape or orientation of the module 130 with LEDs thereon so as to provide a single modular LED lighting fixture 100 which may be altered from any of Types I, II, III, IV or V roadway classifications by swapping out differently configured LED modules 130.

Accordingly, for a given LED module 130, one, some, or all strips 138 or groups of strips 138 having LEDs 135 thereon can be mounted at different angles to the planar, bottom surface of the fixture housing 110. Additionally, a given strip 138 may be straight or curved, and may be angled with respect to one or more dimensions. In another example, each LED 135, groups or strips 138 of LEDs 135 constituting the LED module 130 may include the same or different secondary optics and/or reflectors. In other examples, the groups or strips 138 of LEDs 135 for a given LED module 130 may be mounted at varying ranges of angles, and different optical elements or no optical elements may be used with the groups or strips 138 of LEDs 135 mounted at differing ranges of angles. The angles of the LED strips 138 and/or LEDs 135 with or without optical elements can be fixed or varied in multiple dimensions. Therefore, one or more strips 138 of LEDs 135 constituting LED module 130 can be set at selected angles (which may be the same or different for given strips 138) to the bottom surface of the fixture housing 110, so as to produce any of IESNA-specified Type I, Type II, Type III, Type IV and Type V roadway illumination patterns.

Example configurations of angled LEDs 135 or angled strips 138 of an LED module 130 are described in detail in co-pending and commonly assigned U.S. patent application Ser. No. 11/519,058, to VILLARD et al, filed Sep. 12, 2006 and entitled "LED LIGHTING FIXTURE", the relevant portions describing the various mounting angles of strips 138 and/or LEDs 135 being hereby incorporated in its entirety by reference herein.

Further as discussed above, brightness and performance of the LED lighting fixture 100 may also be adjusted by adding, subtracting or replacing its power supply unit 120. In a particular example, the LED module 130 may have a trapezoidal shape with 15 LEDs 135 on each side except the backside, and oriented at a 25° angle from normal utilizing oval optics. This provides a 50° angle from normal for a desired lighting application In another example, the LEDs 135 may be mounted to a flextape with a bond wire electrically connecting the flextape to each of the LEDs 135. The flextape may be adhered to the copper backing 139 in FIG. 6 or directly to the housing 110. This permits orientations or shapes of the copper backing 139 or housing 110 other than flat or planar, which may also facilitate desired angles of inclination of the LEDs 135 from normal for desired light output from fixture 100. Details of the flextape are described in commonly-assigned U.S. patent application Ser. No. 11/476,836, filed Jun. 29, 2006 to Peter Andrews and entitled "LED PACKAGE WITH FLEXIBLE POLYIMIDE CIRCUIT AND METHOD OF MANUFACTURING LED PACKAGE", the relevant portions describing the flextape being hereby incorporated in their entirety by reference herein.

The flextape may include multiple layers, such as a metal trace (conductive layer) between two polyimid layers. The layers may include a polyimid layer of flexible plastic resin. Polyimid material is a synthetic polymeric resin of a class that is resistant to high temperatures, wear and corrosion. Polyimid materials have been used primarily as a coating or film on a substrate substance and are electrically insulating materials.

The metal trace may be formed of copper, silver, alloys thereof of copper or silver or other metal materials having high electrical conduction properties. The flextape may be coated with SnPb or Pb to facilitate soldering of the bond wire to the LED to the flextape. A high temperature solder such as Sn, AgSn, AuSn, etc. may be used as the soldering agent, for example. Another way to connect the flextape may be by wirebonding.

The use of flextape may facilitate the manufacturing process as compared to conventional manufacturing techniques. The flextape, due to its constituent component construction, can withstand relatively high temperatures (i.e., 300° C.) without damage. Accordingly, during the manufacturing process, a high temperature solder (such as Sn, AgSn, AuSn, etc.) can be applied to flextape, copper plate, LED, or to any combination of these components.

The flextape may include multiple, intricate circuitry and metal trace patterns for applications where it may be desirable to use multiple, different LEDs 135 of the module 130 (e.g., multiple colors such as red, green, and blue). Furthermore, these complex patterns may be relatively easy and cost effective to implement using existing flextape techniques. A flextape having complex patterns may enable the manufacture of LED modules 130 having sophisticated functions at a minimal increase in cost. This may be due in part to the fact that flextape may be manufactured in mass using a reel-to-reel production technique, for example.

In another example, the modular LED lighting fixture 100 may include a backing sheet of thermally conductive material and an array of LEDs 135 to form a LED module or package as described in co-pending and commonly assigned U.S. patent application Ser. No. 11/379,726 to Russ Villard, filed Apr. 21, 2006 and entitled "LED LIGHTING FIXTURE WITH IMPROVED HEATSINK", the relevant portions of which are hereby incorporated in their entirety by reference herein.

The term "array of LEDs" as used herein means a module 130 of one or more LEDs 135 in various configurations and arrangements. The backing plate includes a cell structure. The cell structure includes a plurality of hollow cells contiguously positioned in a side by side manner. The array of LEDs 135 is mounted to a printed circuit board (PCB). The PCBs for the two or more arrays may be attached to the cell structure to balance heat dissipation and color uniformity of the LEDs.

Figure 8:
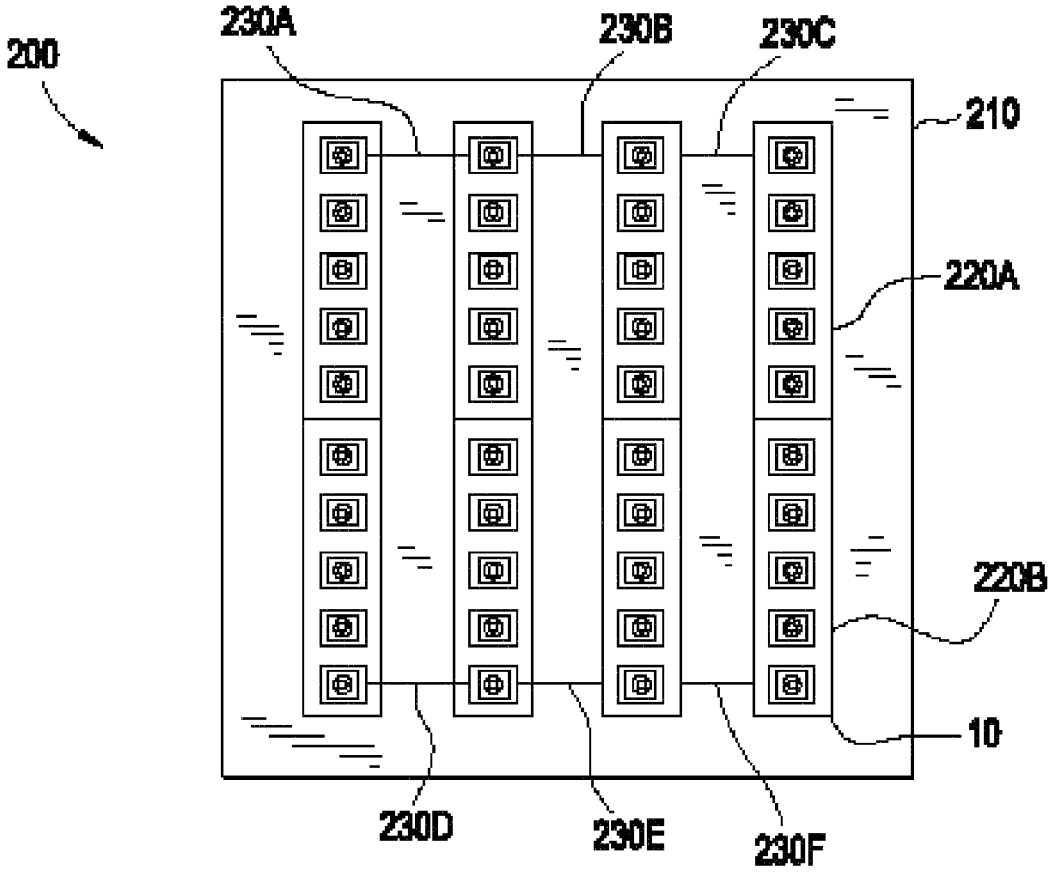
FIG. 8 is a top view of an LED lighting package in accordance with an example embodiment.

FIG. 8 shows a top view of a light emitted diode (LED) lighting package 200 described in the in accordance with the present invention. The LED lighting package 200 may be used in the fixture 100 and includes a backing 210 of thermally conductive material such as aluminum due to its abundance and inexpensive cost, although other thermally conductive materials such as copper, ceramics, plastics, and the like may be utilized. In this example, the LED lighting package 200 includes four columns of LEDs 135. Each column in this example may include at least two printed circuit boards (PCB) such as PCB 220A and 220B. On each PCB, at least five LEDs, such as LED 135 are mounted and electrically connected in series with each other, it being understood that more or less LEDs could be serially mounted. In this example, the total number of LEDs 135 in LED lighting package 200 is forty.

Each PCB 220A/B includes a positive voltage terminal and a negative voltage terminal (not shown). The negative voltage terminal of PCB 220A is electrically connected to the positive voltage terminal of PCB 220B so that the ten LEDs defining a column are electrically connected in serial. Although two PCBs are shown to construct one column of LEDs, a single PCB may also be utilized for a particular column of LEDs. Each column of ten LEDs is electrically connected in parallel to its adjacent column over wires 230A-D and are equally spaced at a distance d measured in the horizontal direction from the center of adjacent LEDs. For example, the distance, d, in FIG. 8 may be approximately 2.4 inches, although other dimensions are possible. In the vertical direction, the LEDs are equally spaced at a distance, v, where v may be approximately 1 inch, although other dimensions are possible. The backing 210 may be anodized white aluminum to reflect the light emitted from the LEDs.

Figure 9:
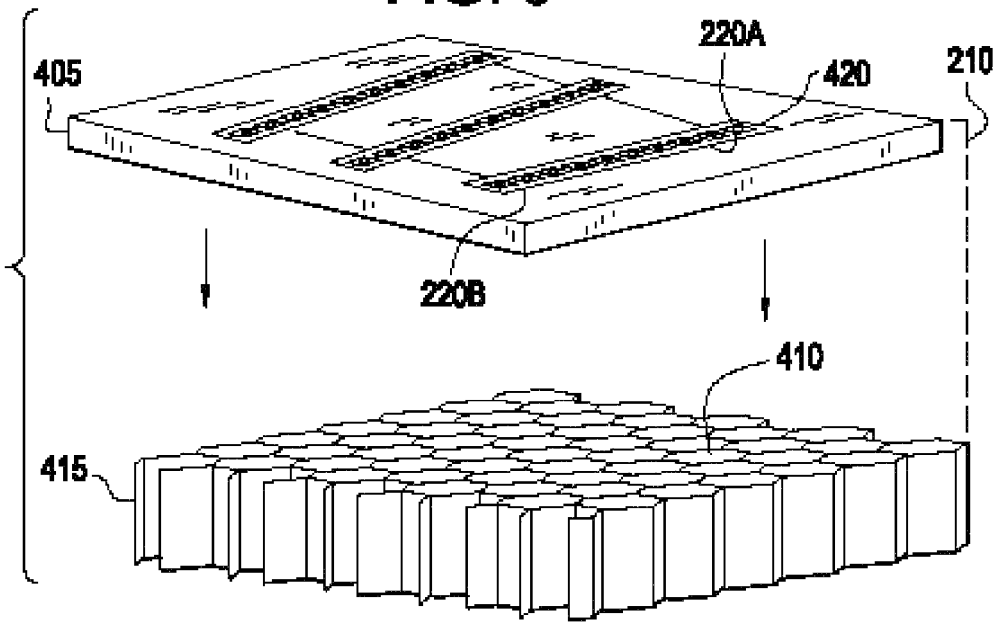
FIG. 9 is a perspective view of the backing shown in FIG. 8.

FIG. 9 is a perspective view of one embodiment for the backing 210 shown in FIG. 8 in accordance with the present invention. Backing 210 includes an aluminum panel 405 fixedly attached to a cell structure 415. The cell structure 415 is composed of a plurality of hexagonally shaped hollow cells such as cell 410 contiguously positioned in a side by side manner. Cell structure 415 has substantially the same length and width dimensions as the aluminum panel 405, so as to align the edges of aluminum panel 405 with the edges of cell structure 415.

The aluminum panel 405 may be suitably attached to cell structure 415 utilizing a thermal epoxy such as Loctite® 384. Although aluminum is the example thermally conductive material, that other thermally conductive material such as graphite may also be utilized. When light is emitted from LEDs 420 affixed to the printed circuit boards (PCBs) PCBs 220A and 220B, heat is dissipated through the aluminum panel 405 and the surface area of the hexagonally shaped cells.

Figure 10A:
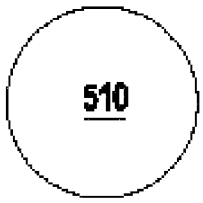
FIGS. 10A-10F show top views of alternative shapes for a cell shown in FIG. 9.
Figure 10B:
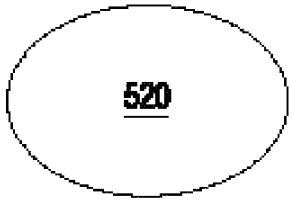
Figure 10C:
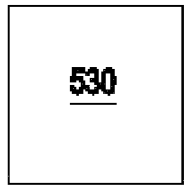
Figure 10D:
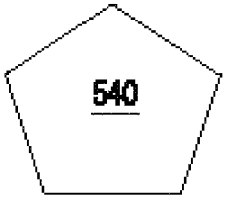
Figure 10E:
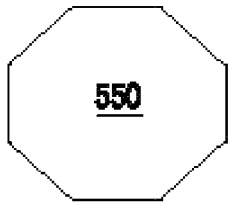
Figure 10F:
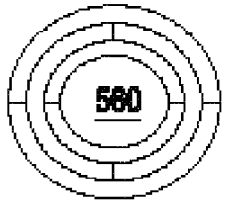

FIGS. 10A-10F show top views of alternative shapes for cell 410 according to the present invention. FIG. 10A shows a top view of a circular cell 510. FIG. 10B shows a top view of an elliptical cell 520. FIG. 10C shows a top view of a square cell 530. FIG. 10D shows a top view of a pentagonal cell 540. FIG. 10E shows a top view of an octagonal cell 550. It is recognized that other cell shapes may be utilized for cell structure 415. FIG. 10F shows a top view of a cell 560 composed of concentric circles. It is recognized that other cell shapes may be utilized for cell structure 415. The cell shapes of FIGS. 10A-F may be contiguously arranged on a side-by-side basis to form a cell structure suitable for an alternative cell structure 415.

Figure 11:
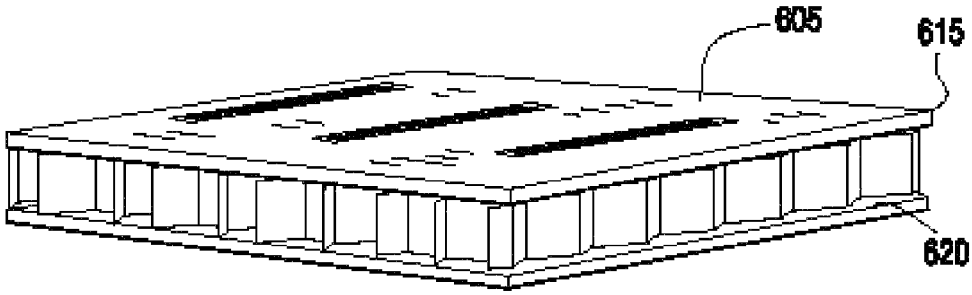
FIG. 11 shows a perspective view of the backing with a bottom flat panel attached thereon.

FIG. 11 shows a perspective view of an alternative backing arrangement 600 in accordance with the present invention which may be suitably employed as the backing 210 in FIG. 8. Backing arrangement 600 includes a top flat panel 605 attached to a cell structure 615 in a manner similar to FIG. 9. Optional bottom flat panel 620 is attached to the bottom of cell structure 615. The optional bottom flat panel 620 has substantially the same dimensions as flat panel 605 and is fixedly attached to the cell structure 615. Bottom flat panel 620 may be employed to address lighting applications requiring a flat surface in back of a lighting package such as display models where the bottom flat panel 620 of a lighting package such as lighting package 300 is utilized when mounting the lighting package to a structure such as a wall or stanchion.

Figure 12:
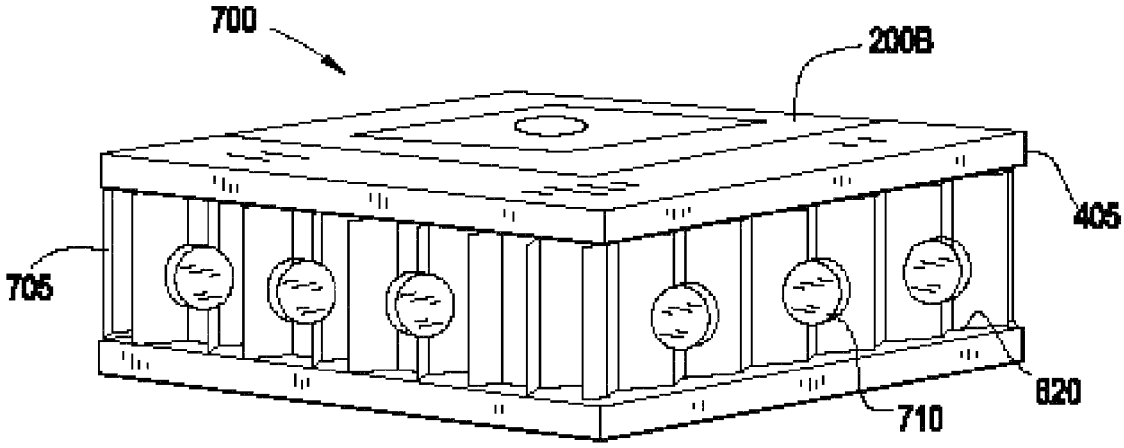
FIG. 12 shows a perspective view of a portion of the backing shown in FIG. 11.

FIG. 12 shows a perspective view of a portion of an alternative backing 700 in accordance with the present invention. In backing 700, cell structure 705 is composed of a plurality of hexagonally shaped hollow cells. Cell structure 705 includes a series of ten bores drilled in both the x and y direction transverse to the hexagonally shaped hollow cells. Each bore such as bore 710 has a given diameter, such as a ⅛ inch diameter. The separation between adjacent bores may be approximately 1 inch on center, for example. It is recognized the number of bores which are drilled are dependent on the diameter of each bore. Consequently, more bores may be drilled that have smaller diameters. Additionally, it is recognized that varied diameters of bores may alternatively be utilized.

Figure 13:
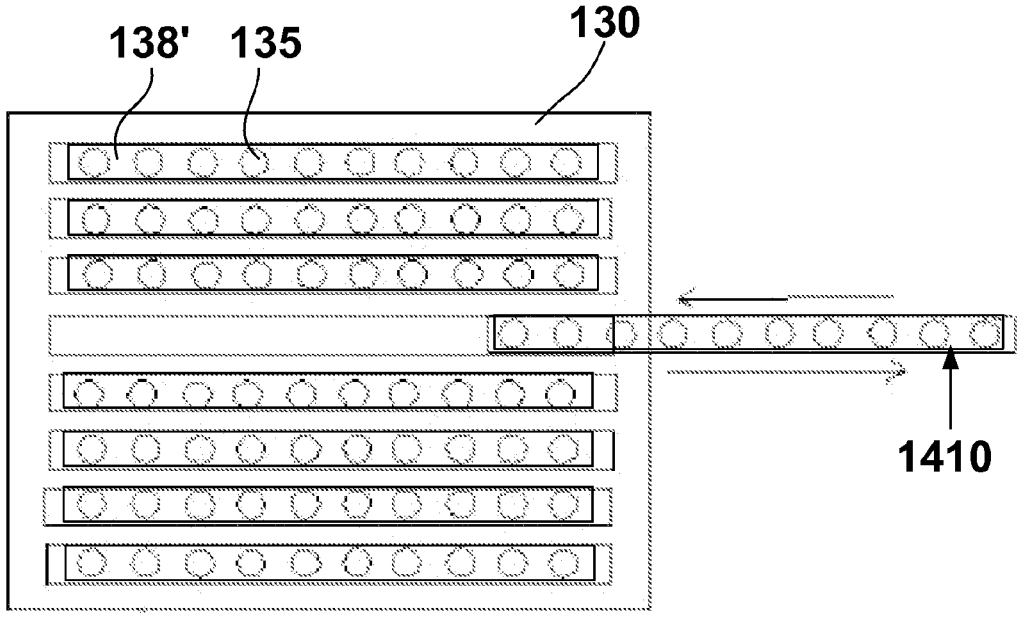
FIG. 13 illustrates an LED module in accordance with another example embodiment.
Figure 14:
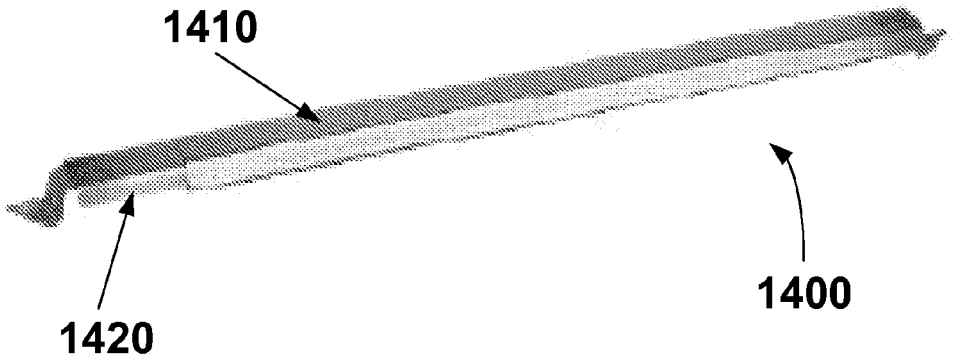
FIG. 14 illustrates a slider bracket assembly used in the LED module of FIG. 13.

FIG. 13 illustrates an LED module 130 in accordance with another example embodiment, and FIG. 14 illustrates a slider bracket assembly 1400 used in the LED module 130 of FIG. 13. The LED module 130 may be attached within the fixture housing 110 as shown in FIGS. 1 and 5, for example. The LED module 130 comprises a plurality of LEDs 135 mounted on PCB strips 138', which in turn adhere or are mechanically coupled to a plurality of slider bracket assemblies 1400. Each slider bracket assembly 1400 comprises a movable slider bracket 1410, which in an example has an inverted U-shape, and a fixed slider bracket support 1420, which in an example has a corresponding inverted U-shape.

The slider bracket assembly 1400 may be mounted on a surface of fixture housing 110 with a thermal epoxy, for example, or by mechanical means. Thermal grease may be utilized in the slider mechanism between the movable bracket 1410 and fixed bracket 1420 shown in FIG. 14 to facilitate the sliding movement of movable bracket 1410 on the fixed bracket 1420. With the LEDs 135 mounted on PCB strips 138', which in turn are affixed to corresponding movable brackets 1410, the sets of LEDs 135 can be unplugged and slipped out for ease of replacement or upgrade.

In an example, up to 10 LEDs 135 can be serially mounted on a PCB strip 138' affixed to a top surface of a movable bracket 1410, up to at least approximately a 45° with the planar surface of fixture housing 110. This is due to the U-shape of the sliding mechanism of the bracket assembly 1400. In an example, the bracket assembly 1400 can be a SIOUX CHIEF™ 12-19 inch long slider bracket made of copper clad galvanized materials. However, other materials could be used as is known in the art.

The example embodiments of the present invention being thus described, it will be obvious that the same may be varied in many ways. For example, the flextape may be embodied other than as a polyimid polymer film. In one example, the application of a polyimid such as PYROLUX® by DuPont may be sprayed on a metal substrate (backing) of a suitable thickness, (such as 2 μm thick). A leadframe such as copper (Cu) may be used for the metal traces and die attach platform. The top of the flextape could be insulated or not depending on needs/desires of the application or LED. Additionally, the polyimid could be etched as desired into a "flex-print" type lead configuration and applied to a heat sink.

Such variations are not to be regarded as departure from the spirit and scope of the example embodiments of the present invention, and all such modifications as would be obvious to one skilled in the art are intended to be included within the scope of the following claims.

What is claimed:

1. A modular light emitting diode (LED) fixture, comprising:

a housing, a modular, removable LED module attached within the housing to a first mounting surface, the removable LED module including at least a first group of LEDs mounted at an angle to a bottom surface of the housing and a second group of LEDs mounted at a different angle to the bottom surface of the housing, and at least one modular, removable LED driver attached within the housing to a second mounting surface for supplying power to the LED module;

wherein the LED module and the LED driver are removable from the first and second mounting surfaces.

2. The fixture of claim 1, wherein the housing has a top surface, the bottom surface, and a proximal end to which a support is affixed thereto for supporting the fixture in a lighting environment, and a distal end.

3. The fixture of claim 2, wherein the removable LED module and removable LED driver are attached to the bottom surface in side-by-side relation in a square or rectangular arrangement.

4. The fixture of claim 2, further comprising: a plurality of spaced-apart fins extending across the top surface of the fixture for providing a heat spreading function.

5. The fixture of claim 2, further comprising: a hinged window attached to the distal end of the fixture so as to cover the removable LED module, and a hinged protective door attached to the proximal end of the fixture so as to cover the removable LED driver, the door and window in a closed position forming an outer, bottom surface of the fixture.

6. The fixture of claim 1, wherein the at least one LED driver is a constant current driver configured to provide between 90 and 240 volts to the LED module.

7. The fixture of claim 1, wherein one or both of the LED module and the LED driver is configured to a roadway illumination pattern selected from the group consisting of direct illumination in two directions along the direction of the roadway, in a straight directional pattern at a cross section, in an omni-directional pattern across an intersection, at an angle to normal in two directions, or at an angle to normal in four directions.

8. The fixture of claim 1, wherein the LED module comprises a plurality of PCB strips, each PCB strip including a plurality of serially-connected LEDs thereon.

9. The fixture of claim 8, wherein one or more LEDs in the module or one or more strips of LEDs are configured to output different colored light.

10. The fixture of claim 8, wherein one or more LEDs in the module or one or more strips of LEDs in the LED module are fitted with a secondary optic.

11. The fixture of claim 8, wherein the PCB strips are embodied as flextape having a plurality of LEDs thereon, the flextape comprising one or more layers of plastic resin.

12. The fixture of claim 8, wherein one or more strips of LEDs in the LED module are mounted on a slider bracket assembly that enables removal and replacement of a given strip in the LED module.

13. The fixture of claim 8, further comprising a backing of thermally conductive material supporting the plurality of PCB strips with LEDs thereon and removably attachable to the bottom surface of the housing.

14. The fixture of claim 13, wherein the backing is an aluminum plate.

15. The fixture of claim 13, wherein the backing comprises an aluminum plate supporting the plurality of PCB strips with LEDs on a first surface, an having a second surface attached to a cell structure that is interposed between the plate second surface and the bottom surface of the housing, the plate and cell structure providing a heat spreading function for the LEDs thereon.

16. The fixture of claim 15, wherein the cell structure comprises a plurality of hollow cells contiguously positioned in a side-by-side manner, the cells having any of a circular, oval, square, pentagonal, hexagonal, octagonal and concentric circular shape.

17. The fixture of claim 15, wherein the cell structure includes a plurality of bores there through in at least two dimensions of the structure to promote the thermal dissipation of heat generated by the strips of LEDs thereon.

18. The fixture of claim 1, wherein the angle is variable for one or more strips of LEDs of the LED module.

19. The fixture of claim 1, wherein one or more strips of LEDs are set at selected angles to the bottom surface of the housing so as to produce a roadway illumination pattern selected from the group consisting of direct illumination in two directions along the direction of the roadway, in a straight directional pattern at a cross section, in an omni-directional pattern across an intersection, at an angle to normal in two directions, or at an angle to normal in four directions.

20. The fixture of claim 1, wherein the first mounting surface comprises an area up to approximately 90 $in^2$.

21. A modular light emitting diode (LED) fixture, comprising:

a housing, a plurality of individually removable PCB strips attached within the housing to a first mounting surface, the plurality of PCB strips including at least a first strip mounted at an angle to a bottom surface of the housing and a second strip mounted at a different angle to the bottom surface of the housing, each strip having one or more LEDs thereon, and at least one modular, removable LED driver attached within the housing to a second mounting surface for supplying power to the LEDs on the PCB strips wherein the PCB strips and the LED driver are removable from the first and second mounting surfaces.

22. The fixture of claim 21, wherein one or more strips of LEDs are mounted on a slider bracket and wherein the one or more strips of LEDs are removable by sliding.

23. The fixture of claim 21, wherein a cross-sectional thickness of the fixture is 3.0 inches or less and the total light output of the fixture is at least 6,300 lumens.

24. The fixture of claim 21, wherein the total light output of the fixture is in a range of between 6,300 to 8,100 lumens.

25. The fixture of claim 21, wherein the plurality of strips of PCBs with LEDs thereon comprises an LED array, and the light output per square inch of the LED array is at least 70 lumens/$in^2$.

26. A modular light emitting diode (LED) fixture, comprising:

a housing, a removable array of LEDs attached within the housing to a first mounting surface, the removable array including at least a first group of LEDs mounted at an angle to a bottom surface of the housing and a second group of LEDs mounted at a different angle to the bottom surface of the housing, at least one modular, removable LED driver attached within the housing to a second mounting surface for supplying power to the LED array, the LED array and LED driver;

wherein the array of LEDs and the LED driver are removable from the first and second mounting surfaces.

27. The fixture of claim 26, further comprising: a plurality of heat spreading fins arranged on the housing.

28. The fixture of claim 26, wherein one or both of the LED array and the LED driver is configured to generate a roadway illumination pattern selected from the group consisting of direct illumination in two directions along the direction of the roadway, in a straight directional pattern at a cross section, in an omni-directional pattern across an intersection, at an angle to normal in two directions, or at an angle to normal in four directions.

29. The fixture of claim 26, wherein a cross-sectional thickness of the fixture is 3.0 inches or less and the total light output of the fixture is at least 6,300 lumens.

30. The fixture of claim 26, wherein the total light output of the fixture is in a range of between 6,300 to 8,100 lumens.

31. The fixture of claim 26, wherein the light output per square inch of the LED array is at least 70 lumens/$in^2$.

32. A modular light emitting diode (LED) fixture, comprising:

a housing, a modular, removable LED module attached within the housing over a first mounting surface, the removable LED module including at least a first group of LEDs mounted at an angle to a bottom surface of the housing and a second group of LEDs mounted at a different angle to the bottom surface of the housing, and at least one modular, removable LED driver attached within the housing over a second mounting surface for supplying power to the LED module;

wherein the first and second mounting surfaces are disposed such that the LED module and the LED driver are removable from a same side of the housing.

* * * * *